US010292419B1

(12) United States Patent
Sanchez Icaza

(10) Patent No.: US 10,292,419 B1
(45) Date of Patent: May 21, 2019

(54) CIGAR LOCK AND ROLLING METHOD

(71) Applicant: Enrique Fernando Sanchez Icaza, Miami, FL (US)

(72) Inventor: Enrique Fernando Sanchez Icaza, Miami, FL (US)

( * ) Notice: Subject to any disclaimer, the term of this patent is extended or adjusted under 35 U.S.C. 154(b) by 1087 days.

(21) Appl. No.: 14/250,428

(22) Filed: Apr. 11, 2014

(51) Int. Cl.
*A24D 1/02* (2006.01)

(52) U.S. Cl.
CPC ..... *A24D 1/027* (2013.01)

(58) Field of Classification Search
CPC ..... A24D 1/02; A24D 1/027
See application file for complete search history.

(56) References Cited

U.S. PATENT DOCUMENTS

| | | | | |
|---|---|---|---|---|
| 442,945 | A | 12/1890 | Boman | |
| 756,752 | A | 4/1904 | Wessels | |
| 1,373,577 | A | 4/1921 | Vallens | |
| 1,458,585 | A | 6/1923 | McCrosson | |
| D68,081 | S | 9/1925 | Baer | |
| 1,555,486 | A | 9/1925 | Rundell | |
| 1,743,014 | A | 1/1930 | Brown | |
| 2,156,780 | A | 5/1939 | Ebert | |
| 4,053,046 | A | 10/1977 | Roark | |
| 5,749,461 | A | 5/1998 | Guzman | |
| D404,516 | S | 1/1999 | Benhamou | |
| D404,518 | S | 1/1999 | Dal Monte | |
| D404,519 | S | 1/1999 | Dal Monte | |
| D410,107 | S | 5/1999 | Dal Monte | |
| 2009/0159090 | A1* | 6/2009 | Pienemann | A24C 5/005 131/284 |

FOREIGN PATENT DOCUMENTS

| | | |
|---|---|---|
| GB | 121403 | * 12/1918 |
| GB | 260772 | * 11/1926 |

* cited by examiner

*Primary Examiner* — Michael H. Wilson
*Assistant Examiner* — Dionne W. Mayes
(74) *Attorney, Agent, or Firm* — Thomas M. Joseph, Esq.

(57) ABSTRACT

The present invention is directed toward cigar and method for making the same. The cigar comprises a first layer and filler. The first layer is disposed in retaining relation to the filler to define a wrapped configuration. The wrapped configuration includes an elongated configuration and an open end, the open end dimensioned and configured to expose a corresponding portion of the filler there through. The first layer includes a distal end disposed in overlaying, covering relation to at least a portion of an outer periphery of the open end to at least partially define a cigar lock. The cigar lock includes a perforated construction disposed and structured to facilitate ventilation of the filler. The perforated construction includes at least one perforation extending through the distal end in communicating relation with said filler.

13 Claims, 3 Drawing Sheets

CIGAR LOCK AND ROLLING METHOD

BACKGROUND OF THE INVENTION

Field of the Invention

This invention is directed to a cigar lock disposed on the distal end, or "foot," of a cigar and structured to facilitate an even lighting and uniform burn of the cigar. This invention is further directed toward a method of making a cigar having such a cigar lock.

Description of the Related Art

The history of cigars is one dating back centuries. Christopher Columbus stumbled upon the Americas in 1492 to find the inhabitants were already smoking bundles of twisted tobacco leaves wrapped in dried palm or corn husks. From Columbus's discovery, the consumption of tobacco spread across the Atlantic and grew to become the international industry it is today.

Today, great care is taken in all the steps that yield a quality cigar, beginning with the choice of climate and tobacco plant. Leaves are carefully harvested and aged to balance exposure to heat and shade for weeks to reduce their water and sugar content, as well as alter the desired color of the leaf, through a process called curing. A cured leaf is then allowed to ferment under carefully controlled temperature and humidity conditions to further dry the leaf, bringing out its aroma and flavor characteristics while preventing it from rotting. Some manufacturers may choose to age their leaves further, baling and un-baling them repeatedly for inspections during the aging cycle. Leaves are ultimately sorted for use as a filler or wrapper depending on their quality and appearance.

Handmade cigars are generally considered to be of higher quality than machine-made cigars. Those rolled by hand may use various types of fillers, including long fillers, comprised of long leaves, or more delicate leaves chosen for their aroma, flavor, or burning characteristics. They may also employ a binder, a type of leave used between the wrapper and the filler that helps hold the filler and may permit a delicate choice of leaf as a wrapper. Machine-made or low-grade cigars may use chopped leaves for the filler and a type of paper formed from tobacco pulp as a wrapper.

Among cigar aficionados, it is generally recognized that the lighting of a cigar before smoking is a step of particular importance. Many cigar smokers may even adhere to cultural practices regarding the manner of lighting cigars, such as the choice of the instrument, etiquette concerning the lighting of another's cigar, or the steps and ritual involved in lighting a cigar.

Further, as the parts of a cigar, the binder, and a filler, ignite and burn at different rates, a chief concern is ensuring the uniform lighting of the foot of the cigar. By uniformly lighting the end of the cigar, it helps promote an even, uniform burning of the cigar.

Accordingly, what is lacking from the art is a cigar that is appropriately structured to lend itself to facilitating such a uniform ignition and burn from the onset, furthering a user's enjoyment from the first lighting of the cigar.

SUMMARY OF THE INVENTION

Accordingly, the present invention is directed toward a cigar comprising a "cigar lock" on the distal end, or "foot," of the cigar to facilitate the even lighting and burning of the cigar. It is further directed toward a method of making such a cigar.

The cigar at least comprises a first layer, which may be a wrapper, and an amount of filler. The present invention may further comprise a second layer, which may be another wrapper or a binder. The wrapper, filler, and the binder may be comprised of tobacco or other flammable products. The filler may be a blended assortment of tobacco other bunches of leaves, and/or any other desired product for smoking in the cigar. The binder is a leaf, which may have some elastic properties, and is disposed between the first layer and the filler to aid in retaining the filler. The wrapper is then wrapped around the binder. The cigar may also include a band, disposed around the first layer, the band comprising a display field structured for the presentation of indicia such as the brand of the cigar.

Accordingly, the disposition of the first layer about the filler serves to define a wrapped configuration. In the wrapped configuration, the first layer is in retaining relation to the filler and defines the outermost layer of the cigar. The wrapped configuration also includes an elongated configuration, at least before it is burned.

The distal end of the first layer is folded over the open end of the cigar to cover a portion of the outer periphery of the open end to form the aforementioned cigar lock. The cigar lock includes a perforated construction that facilitates ventilation of the filler. The perforated construction includes at least one perforation, and in at least one embodiment may include more than one, extending through the cigar lock and in communicating relation with the filler. This may facilitate the aforementioned ventilation, and a concurrent burning of the distal end and a corresponding portion of the filler when ignited. The disposition and spatial relationship of the perforations, in such embodiments having more than one, may vary. For example, the perforations may be evenly spaced along the entirety of the length of the distal end, collectively disposed about only a majority or a portion of the distal end, or another pattern as is deemed desirable.

The present invention is further directed toward a method of making a cigar that comprises, in part, disposing a first layer in a surrounding, retaining relation to a filler to form an elongate wrapped configuration, shaping the wrapped configuration to have an open end, disposing part of the first layer to cover the periphery of the open end to form a cigar lock, and structuring the cigar lock to include a perforated construction, the perforated construction including at least one perforation extending through the distal end in communication with the filler. The method of making a cigar, in the various embodiments, may further comprise disposing a plurality of perforations in various arrangements, such as extending along a majority of the length of the distal end or the entirety of the length of the distal end. The perforated construction may also facilitate a concurrent burning of the distal end and a corresponding portion of the filler when ignited.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
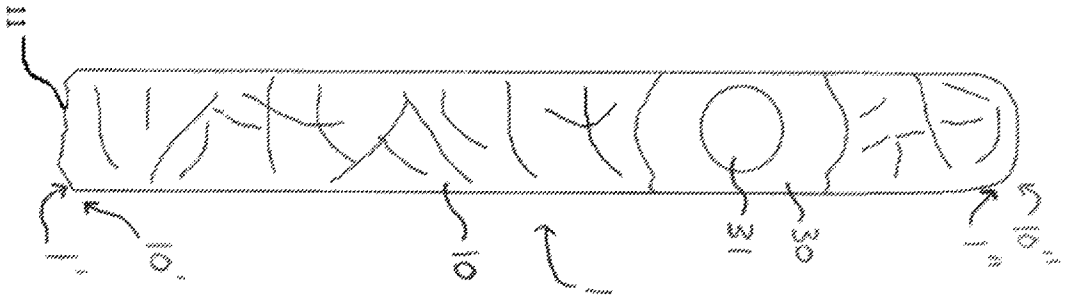
FIG. 1 is a front view of an embodiment of the present invention.

As represented in the accompanying Figures, the present invention is directed to a cigar lock, given as 11 in FIG. 1, and a method for rolling a cigar having such a cigar lock 11.

With reference to FIG. 1, the cigar lock 11 comprises certain structural features located on a cigar, generally given at 1. The cigar 1 is a longitudinal member having a proximal end 1" for placement within a user's mouth and a distal end 1' for lighting with a heat source. The length of the cigar 1 is defined as a measurement spanning the distance between the proximal end 1" and the distal end 1'. The cigar 1 comprises structural features, as will be discussed more fully below. The combustion or burning of the cigar 1 releases smoke, which can be drawn through the cigar 1 and into the user's mouth through the proximal end 1". The cigar lock 11 is near the distal end 1' of the cigar 1. The distal end 1' of the cigar 1 is the end that is ignited when smoking the cigar 1, as opposed to the portion that is placed in the user's mouth.

The cigar 1 comprises a first layer 10 and filler 50. The first layer 10 may comprise what is commonly called a "wrapper." The first layer 10 is combustible and extends the length of the cigar 1. It may comprise one or more tobacco leaf. The first layer 10 is pliable and may be disposable between an unwrapped and wrapped state. In the wrapped state, the first layer 10 is disposed about the filler 50, which is also combustible and may comprise one or more kinds of tobacco or other additives chosen for e.g. flavor or aroma. Such disposition of the first layer 10 about the filler 50 defines a wrapped configuration having an elongated configuration. Further, in the wrapped configuration, the first layer 10 is disposed about the filler 50 in a retaining relation to the filler 50. The retaining relation helps keep the filler 50 contained within the cigar 1, for example. Further still, in the wrapped configuration, the first layer 10 defines the outermost surface of the cigar 1.

Figure 4:
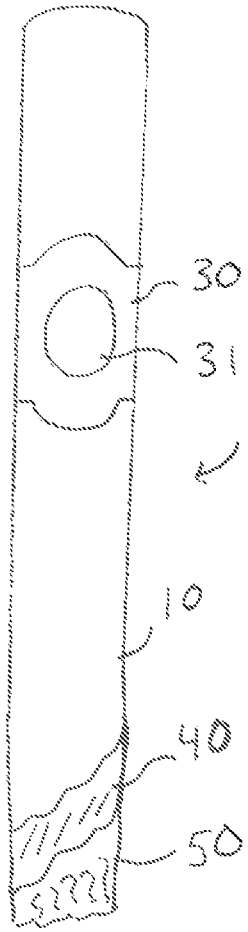
FIG. 4 is a front view in partial cutaway to depict internal structure of the embodiment of FIG. 1.

With reference to FIG. 4, in at least one embodiment, the cigar 1 further comprises a second layer 40 disposed between the first layer 10 and the filler 50. The second layer 40 may be what is commonly referred to as a "binding" or "binder." Alternatively, in at least one embodiment, the second layer 40 may be one or more wrappers. The second layer 40 extends substantially the length of the cigar 1 and is also combustible. Additionally, the second layer 40 may be comprised of tobacco.

Figure 2:
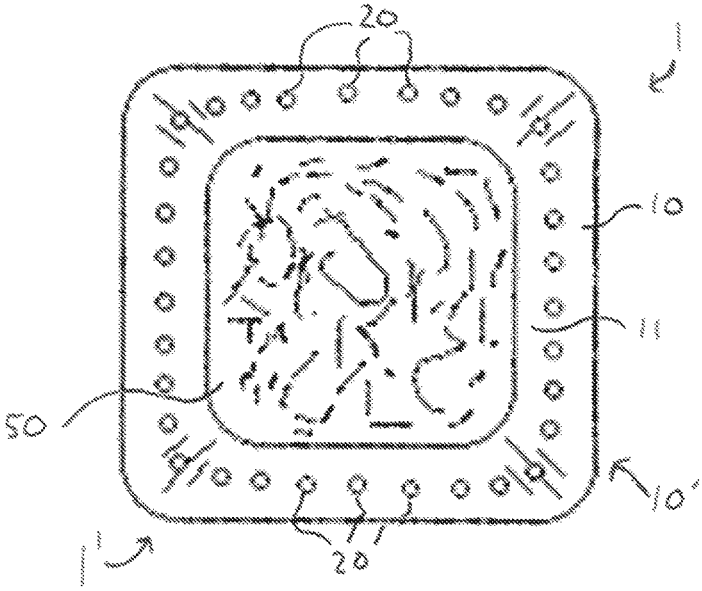
FIG. 2 is a bottom view of the embodiment of FIG. 1.

In at least one embodiment, the cigar 1 may comprise a cross section resemblant of a rectangle with rounded corners, as shown in FIG. 2. However, other embodiments having other cross-sectional shapes are possible, including but not limited to circular, oval, rectangular, etc. In at least one embodiment, the aforementioned wrapped configuration includes an open end, as shown in FIG. 2. A cigar lock 11 is formed at the open end of the wrapped configuration. Accordingly, a portion of the first layer 10 near the distal end 1' of the cigar 1 is oriented transversely relative to the length of the cigar 1 to enclose the end of the cigar 1, forming the aforementioned cigar lock 11. This may also be described as forming the cigar lock 11 through disposition in a covering relation between a distal end 10' of the first layer 10 and at least a portion of an outer periphery of an "open end" or exposed amount of filler 50. The cigar lock 11 may help retain the filler 50 such as during storage, transportation, and handling of the cigar 1. Further, the cigar lock 11 facilitates concurrent burning of the distal end 1' and a corresponding amount of the filler 50 when ignited. This may be achieved in at least one embodiment by the selection of a first layer 10 that is more easily and quickly ignited than the filler 50. Thus, the cigar lock 11 uniformly and easily ignites and continues to burn for a time until the filler 50 has ignited.

Additionally, in at least one embodiment, the cigar lock 11 comprises perforations 20 as depicted in FIG. 2. Thus, the cigar lock 11 is said to be of perforated construction. These perforations 20 extend entirely through perforated construction of the cigar lock 11 and are in communicating relation with the filler 50. The perforations 20 facilitate a more uniform and even ignition of the cigar lock 11. Additionally, the perforations 20 facilitate the flow of air through the first layer 10 to the filler 50, thereby facilitating ventilation. This air flow allows for oxidation of the filler 50 so it more readily and evenly combusts without compromising the aforementioned retention advantages provided by the cigar lock 11. FIG. 2 is an illustration of perforations 20 that extend the entirety of the length of the cigar lock. In addition, the perforations 20 are arranged in equivalently spaced relation relative to one another, in that the spacing between any two perforations 20 is nearly equal to the spacing between any other two perforations 20. However, in other embodiments, the perforations 20 may extend at least a majority of the length of the cigar lock 11, or may be spaced in ways other than equivalently. The perforations 20 may be collectively disposed, i.e. grouped together and distributed along only a portion of the length of the cigar lock 11, as an example of an alternative distribution.

In at least one embodiment, disposed about the cigar 1 may be a band 30. The band 30 may comprise a display field structured for the presentation of indicia 31. The indicia 31 may be representative of e.g. the source of origin of the cigar 1, i.e. the brand, or other desired information.

Figure 3:
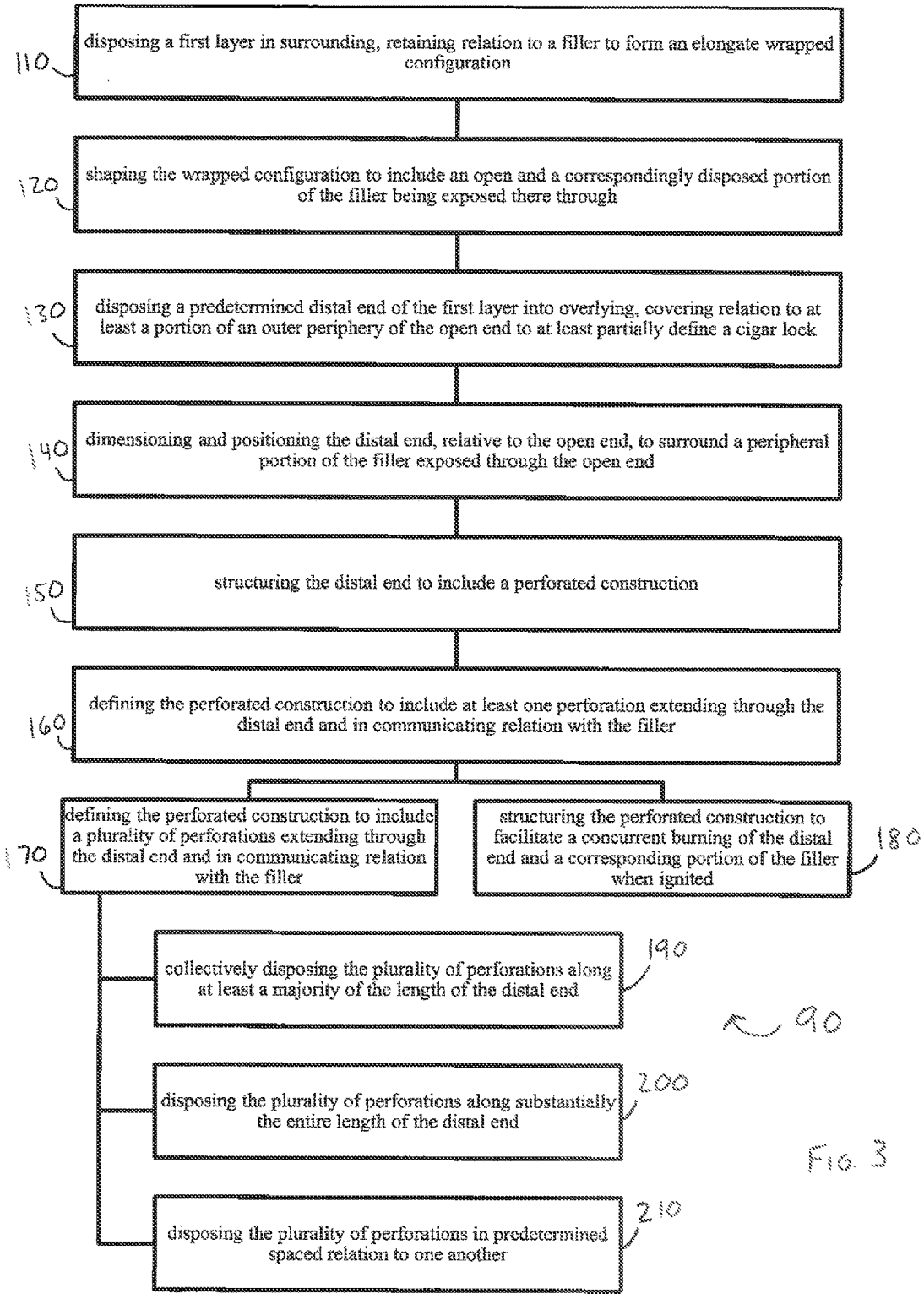
FIG. 3 is a diagram of the method of the present invention.

Further, the present invention is directed toward a method, generally indicated at 90 in FIG. 3, of making a cigar 1. The method 90 comprises disposing a first layer 10 in surrounding, retaining relation to a filler 50 to form an elongate wrapped configuration, as at 100. The distal end 10' of the first layer 10 is the portion of the first layer 10 that will define the distal end 1' of the cigar 1 as well, as the two are nearly coextensive. The method 90 further comprises shaping the wrapped configuration to include an open end and a correspondingly disposed portion of the filler 50 being exposed there through, as at 120. The structure and appearance of the open end may be better understood in consideration of FIG. 2, which depicts one embodiment of a cigar having an open end that may be constructed via the present method. This may be taken in conjunction with the explanation of the open end set forth above. The method 90 further comprises disposing a predetermined distal end 10' of the first layer 10 into overlying, covering relation to at least a portion of an outer periphery of the open end to at least partially define a cigar lock 11, as at 130. The method further comprises dimensioning and positioning the distal end 10', relative to the open end, to surround a peripheral portion of the filler 50 exposed through the open end, as at 140. The method 90 further comprises structuring the distal end 10' to include a perforated construction, as at 150, and defining the perforated construction to include at least one perforation 20, but more practically a plurality of perforations 20 as explained above, extending through the distal end 10' and in communicating relation with the filler 50, as at 160.

Figure 5:
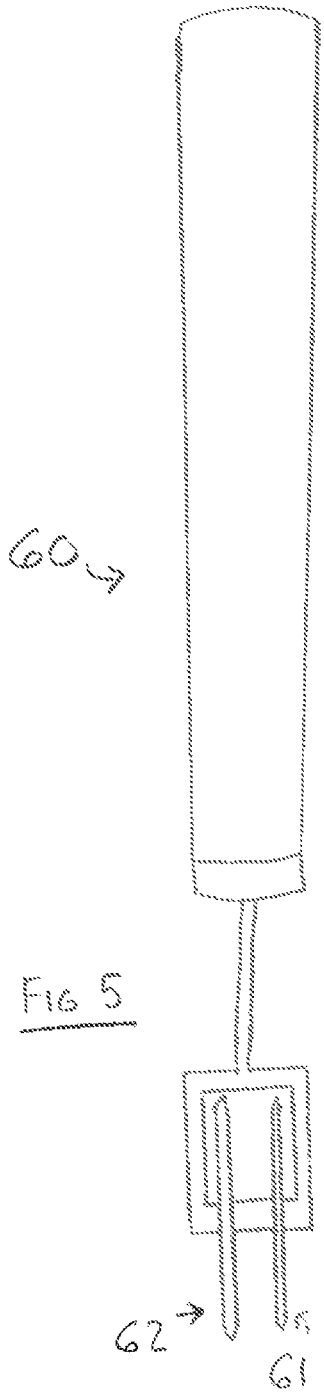
FIG. 5 is an embodiment of a tool for use with a method of the present invention.
Figure 6:
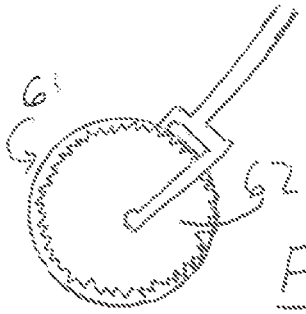
FIG. 6 is a close up view of the tool of FIG. 5 in partial cutaway.

The creation of the perforations in the method 90 can be achieved through use of a tool 60 resemblant of what is known as a pizza cutter or pizza wheel, an embodiment of which is shown in FIGS. 5 and 6. In addition to a first wheel 61 that performs the traditional slicing function, this tool 60 has a second wheel 62 spaced slightly apart from and oriented parallel to the first wheel 61. The second wheel 62 has a coextensive diameter as the first wheel. Additionally, the second wheel 62 has a plurality of spikes 63 extending radially therefrom. The first layer 10, i.e. wrapper, is laid flat prior to trimming. The tool 60 is rolled over an edge of the first layer 10. When rolling the cutting tool 60 over the edge of the first layer 10, the effect is to trim the first layer 10 and simultaneously produce a plurality of perforations 20 with one pass of the cutting tool 60. In addition, the method comprises disposing the first layer 10 about the filler 50, as at 200 of FIG. 3.

In at least one embodiment, the method 90 may comprise structuring the perforated construction to facilitate a concurrent burning of the distal end 10' and a corresponding portion of the filler 50 when ignited, as at 180.

In at least one embodiment, the method 90 may comprise defining the perforated construction to include a plurality of perforations 20 extending through the distal end 10' and in communicating relation with the filler 50, as at 170. Further, in at least one embodiment, the method 90 may comprise disposing the plurality of perforations 20 along substantially the entire length of the distal end 10', as at 200. Further still, in at least one embodiment, the method 90 may comprise disposing the plurality of perforations 20 in predetermined spaced relation to one another, as at 210. The structure, arrangement and spacing of the perforations 20 of the cigar lock 11 is set forth more fully above.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A cigar comprising:

a filler; and a flammable first layer disposed in retaining relation to said filler to define a wrapped configuration, said wrapped configuration including an elongated configuration and a distal end, said distal end disposed in overlaying, covering relation to at least a portion of an outer periphery of said filler, to at least partially define a cigar lock, and said distal end dimensioned and configured to expose a central portion of said filler there through, said cigar lock including a perforated construction disposed and structured to facilitate ventilation of said filler at least partially through said cigar lock, and said perforated construction including at least one perforation extending through said distal end and in communicating relation with said filler.

2. The cigar of claim 1, said perforated construction including a plurality of perforations collectively disposed along at least a portion of a length of said distal end, each of said plurality of perforations extending through said distal end and in communicating relation with said filler.

3. The cigar of claim 2 wherein said plurality of perforations are collectively disposed along at least a majority of the length of said distal end.

4. The cigar of claim 2 wherein said plurality of perforations are collectively disposed along substantially the entire length of said distal end in predetermined spaced relation to one another.

5. The cigar of claim 2 wherein said plurality of perforations are disposed in predetermined spaced relation to one another.

6. The cigar of claim 1, wherein the flammable first layer includes tobacco.

7. A method of making a cigar comprising:

disposing a flammable first layer in surrounding, retaining relation to a filler to form an elongate wrapped configuration, shaping the wrapped configuration to include a distal end and a centrally disposed portion of the filler being exposed there through, disposing the distal end of the flammable first layer into overlying, covering relation to at least a portion of an outer periphery of the filler to a least partially define a cigar lock, dimensioning and positioning the distal end to surround a peripheral portion of the filler, structuring the distal end to include a perforated construction, and defining the perforated construction to include at least one perforation extending through the distal end and in communicating relation with the filler.

8. The method of claim 7 further comprising defining the perforated construction to include a plurality of perforations extending through the distal end and in communicating relation with the filler.

9. The method of claim 8 further comprising collectively disposing the plurality of perforations along at least a majority of the length of the distal end.

10. The method of claim 8 further comprising disposing the plurality of perforations along substantially the entire length of the distal end.

11. The method of claim 8 further comprising disposing the plurality of perforations in predetermined spaced relation to one another.

12. The method of claim 7, wherein the flammable first layer includes tobacco.

13. The method of claim 7 further comprising structuring the perforated construction to facilitate a concurrent burning of the distal end and a corresponding portion of the filler when ignited.

* * * * *